US012258180B2

(12) United States Patent
Yambao et al.

(10) Patent No.: US 12,258,180 B2
(45) Date of Patent: Mar. 25, 2025

(54) TAMPER RESISTANT STORAGE AND TRANSPORT SYSTEM FOR FOOD

(71) Applicants: Alexander Yambao, Las Vegas, NV (US); Ashley Yambao, Las Vegas, NV (US); Maria Eleanor P. Yambao, Las Vegas, NV (US); Allen Yambao, Las Vegas, NV (US)

(72) Inventors: Alexander Yambao, Las Vegas, NV (US); Ashley Yambao, Las Vegas, NV (US); Maria Eleanor P. Yambao, Las Vegas, NV (US); Allen Yambao, Las Vegas, NV (US)

( * ) Notice: Subject to any disclaimer, the term of this patent is extended or adjusted under 35 U.S.C. 154(b) by 55 days.

(21) Appl. No.: 17/947,089

(22) Filed: Sep. 17, 2022

(65) Prior Publication Data

US 2023/0040342 A1 Feb. 9, 2023

Related U.S. Application Data

(63) Continuation-in-part of application No. 17/073,969, filed on Oct. 19, 2020, now abandoned.

(51) Int. Cl.

| | |
|---|---|
| ***B65D 33/34*** | (2006.01) |
| ***B65D 27/20*** | (2006.01) |
| ***B65D 33/16*** | (2006.01) |

(52) U.S. Cl.

CPC ..... *B65D 33/34* (2013.01); *B65D 27/20* (2013.01); *B65D 33/1691* (2013.01); *B65D 2203/02* (2013.01); *B65D 2401/05* (2020.05); *B65D 2543/00953* (2013.01); *B65D 2585/366* (2013.01)

(58) Field of Classification Search

CPC .... B65D 33/34; B65D 33/1691; B65D 27/20; B65D 2401/05; B65D 2203/02; B65D 2543/00953; B65D 2585/366

See application file for complete search history.

(56) References Cited

U.S. PATENT DOCUMENTS

| | | | | | |
|---|---|---|---|---|---|
| 2,537,801 | A * | 1/1951 | Swatsick | B65D 5/68 | 229/125.21 |
| 2,822,973 | A * | 2/1958 | Armstrong | B65D 5/68 | 229/125.21 |
| 3,438,562 | A * | 4/1969 | Wright | B65D 5/0005 | 229/117.02 |
| 3,917,154 | A * | 11/1975 | Dove | B65D 5/441 | 229/117.02 |
| 4,101,052 | A * | 7/1978 | Dove | B65D 5/0005 | 229/101 |

(Continued)

*Primary Examiner* — Peter N Helvey

(57) ABSTRACT

A storage and transport system for food, comprising a container, wherein the container has a bottom portion having at least one slot formed therein, and a top portion having at least one slot formed therein that corresponds to the slot formed in the bottom portion, and wherein when the container is in a closed position, the corresponding slots form at least one channel passing completely through the container; a self-sealing receipt or label configured to receive printed information regarding the contents of the container, wherein the self-sealing receipt or label passes through the at least one channel and is sealed to itself to securely close the container, and wherein the self-sealing receipt or label is configured to provide visual evidence of tampering when the self-sealing receipt or label is separated from itself.

20 Claims, 7 Drawing Sheets

(56) References Cited

U.S. PATENT DOCUMENTS

| | | | | | |
|---|---|---|---|---|---|
| 4,782,977 | A * | 11/1988 | Watanabe | B65D 55/024 | 292/307 R |
| 4,927,074 | A * | 5/1990 | LaRue | B65D 5/68 | 229/125.21 |
| 6,398,028 | B1 * | 6/2002 | Stovall | B65H 37/002 | 206/390 |
| 7,726,552 | B2 * | 6/2010 | Chadima | B65D 5/685 | 232/1 D |
| 9,352,888 | B2 * | 5/2016 | Scott | B65D 55/02 | |
| 10,308,395 | B2 * | 6/2019 | Zhang | B65D 5/0005 | |
| D914,495 | S * | 3/2021 | Wikstrom | D9/432 | |
| 11,511,921 | B1 * | 11/2022 | Wikstrom | B65D 55/165 | |
| 12,033,540 | B2 * | 7/2024 | Krahl | G09F 3/0292 | |
| 2005/0243391 | A1 * | 11/2005 | Drinkwater | B42D 15/025 | 359/31 |
| 2009/0188214 | A1 * | 7/2009 | Vohnout-Marle | G07D 11/12 | 220/666 |
| 2014/0069059 | A1 * | 3/2014 | Scott | B65D 5/68 | 53/416 |
| 2019/0112110 | A1 * | 4/2019 | Taylor | B65D 43/162 | |
| 2019/0344927 | A1 * | 11/2019 | Ozgercel | B65D 5/22 | |
| 2021/0354874 | A1 * | 11/2021 | Konrad | B65D 5/4266 | |
| 2021/0371153 | A1 * | 12/2021 | Borst, Sr. | B65D 5/0254 | |
| 2021/0375160 | A1 * | 12/2021 | Vigunas | G09F 3/0341 | |
| 2022/0017263 | A1 * | 1/2022 | Wikstrom | B65D 5/546 | |
| 2022/0055794 | A1 * | 2/2022 | Humberstone | B65D 85/36 | |
| 2022/0153510 | A1 * | 5/2022 | Bressan | B65D 5/2057 | |
| 2023/0331430 | A1 * | 10/2023 | Valance | B65D 5/2057 | |

* cited by examiner

TAMPER RESISTANT STORAGE AND TRANSPORT SYSTEM FOR FOOD

CROSS-REFERENCE TO RELATED APPLICATIONS

This patent application is a continuation-in-part of U.S. patent application Ser. No. 17/073,969 filed on Oct. 19, 2020 and entitled "Tamper Resistant Containers for Food and Other Items", the disclosure of which is hereby incorporated by reference herein in its entirety and made part of the present U.S. utility patent application for all purposes.

BACKGROUND

The disclosed inventive subject matter relates in general to a containers and packages used for food, perishable items, consumable liquids and other items, and more specifically to a tamper-resistant container for use with carry-out, pick-up, and delivery systems and services used for food and other items.

Carry-out, pick-up, and delivery systems and services used for food and other items are commonplace in modern society. However, such systems and services necessarily involve multiple individuals handling, packaging, and in some circumstances delivering, the food or other items. Customers and consumers of such systems and services are often understandably concerned about the integrity of the packaging that the food or other items is stored in prior to pick-up or delivery and about the accuracy and contents of an order. A purchase receipt is often attached to or included with food packaging that is picked-up or delivered. However, this receipt may become lost, detached, or otherwise separated from the food packaging. Additionally, the food packaging may be opened, damaged, or otherwise tampered with prior to delivery, resulting in customer concern and/or dissatisfaction. Accordingly, a food packaging system that utilizes or includes tamper-resistant features is highly desirable.

SUMMARY

The following provides a summary of certain example implementations of the disclosed inventive subject matter. This summary is not an extensive overview and is not intended to identify key or critical aspects or elements of the disclosed inventive subject matter or to delineate its scope. However, it is to be understood that the use of indefinite articles in the language used to describe and claim the disclosed inventive subject matter is not intended in any way to limit the described inventive subject matter. Rather the use of "a" or "an" should be interpreted to mean "at least one" or "one or more".

One implementation provides a first system for storing and transporting food, comprising a container, wherein the container has a bottom portion having at least one slot formed therein, and a top portion having at least one slot formed therein that corresponds to the slot formed in the bottom portion, and wherein when the container is in a closed position, the corresponding slots form at least one channel passing completely through the container; a self-sealing receipt or label configured to receive printed information regarding the contents of the container, wherein the self-sealing receipt or label passes through the at least one channel and is sealed to itself to securely close the container, and wherein the self-sealing receipt or label is configured to provide visual evidence of tampering when the self-sealing receipt or label is separated from itself. The container may be a pizza box. The slots may be formed by perforating corresponding sections of the top portion of the container and the bottom portion of the container to create collapsible regions. The self-sealing receipt or label may include a plurality of cuts formed completely through the material of the receipt or label, wherein the plurality of cuts form regions of weakness in the receipt or label for providing visual evidence of receipt or label tampering when the self-sealing receipt or label is separated from itself. The self-sealing receipt or label may include an upper surface for receiving printing thereon and a lower surface upon which an adhesive has been deposited. The adhesive may be permanent pressure-sensitive adhesive, cohesive, remoistenable adhesive, repositionable adhesive, or combinations thereof. The adhesive may be deposited in adjacent strips, wherein the strips contain different types of adhesives. The visual evidence of tampering may include visible fiber tears in the receipt or label or visible adhesive transfer from one portion of the receipt or label to another portion of the receipt or label.

Another implementation provides a second system for storing and transporting food, comprising a container, wherein the container has a bottom portion having at least one slot formed therein, and a top portion having at least one slot formed therein that corresponds to the slot formed in the bottom portion, and wherein when the container is in a closed position, the corresponding slots form at least one channel passing completely through the container, and wherein the container is configured for use as a pizza box; a linerless self-sealing receipt or label configured to receive printed information regarding the contents of the container, wherein the self-sealing receipt or label passes through the at least one channel and is sealed to itself to securely close the container, and wherein the self-sealing receipt or label is configured to provide visual evidence of tampering when the self-sealing receipt or label is separated from itself. The slots may be formed by perforating corresponding sections of the top portion of the container and the bottom portion of the container to create collapsible regions. The self-sealing receipt or label may include a plurality of cuts formed completely through the material of the receipt or label, wherein the plurality of cuts form regions of weakness in the receipt or label for providing visual evidence of receipt or label tampering when the self-sealing receipt or label is separated from itself. The self-sealing receipt or label may include an upper surface for receiving printing thereon and a lower surface upon which an adhesive has been deposited. The adhesive may be permanent pressure-sensitive adhesive, cohesive, remoistenable adhesive, repositionable adhesive, or combinations thereof. The adhesive may be deposited in adjacent strips, wherein the strips contain different types of adhesives. The visual evidence of tampering may include visible fiber tears in the receipt or label or visible adhesive transfer from one portion of the receipt or label to another portion of the receipt or label.

Still another implementation provides a third system for storing and transporting food, comprising a container, wherein the container has a bottom portion having at least one slot formed therein, and a top portion having at least one slot formed therein that corresponds to the slot formed in the bottom portion, and wherein when the container is in a closed position, the corresponding slots form at least one channel passing completely through the container, and wherein the slots are formed by perforating corresponding sections of the top portion of the container and the bottom portion of the container to create collapsible regions; a linerless self-sealing receipt or label configured to receive printed information regarding the contents of the container, wherein the self-sealing receipt or label includes an upper surface for receiving printing thereon and a lower surface upon which an adhesive has been deposited, wherein the self-sealing receipt or label passes through the at least one channel and is sealed to itself to securely close the container, and wherein the self-sealing receipt or label is configured to provide visual evidence of tampering when the self-sealing receipt or label is separated from itself. The self-sealing receipt or label may include a plurality of cuts formed completely through the material of the receipt or label, wherein the plurality of cuts form regions of weakness in the receipt or label for providing visual evidence of receipt or label tampering when the self-sealing receipt or label is separated from itself. The self-sealing receipt or label may include an upper surface for receiving printing thereon and a lower surface upon which an adhesive has been deposited, and wherein the adhesive is permanent pressure-sensitive adhesive, cohesive, remoistenable adhesive, repositionable adhesive, or combinations thereof.

It should be appreciated that all combinations of the foregoing concepts and additional concepts discussed in greater detail below (provided such concepts are not mutually inconsistent) are contemplated as being part of the inventive subject matter disclosed herein and may be implemented to achieve the benefits as described herein. Additional features and aspects of the disclosed system, devices, and methods will become apparent to those of ordinary skill in the art upon reading and understanding the following detailed description of the example implementations. As will be appreciated by the skilled artisan, further implementations are possible without departing from the scope and spirit of what is disclosed herein. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more example implementations of the disclosed inventive subject matter and, together with the general description given above and detailed description given below, serve to explain the principles of the disclosed subject matter, and wherein.

DETAILED DESCRIPTION

Figure 1B:
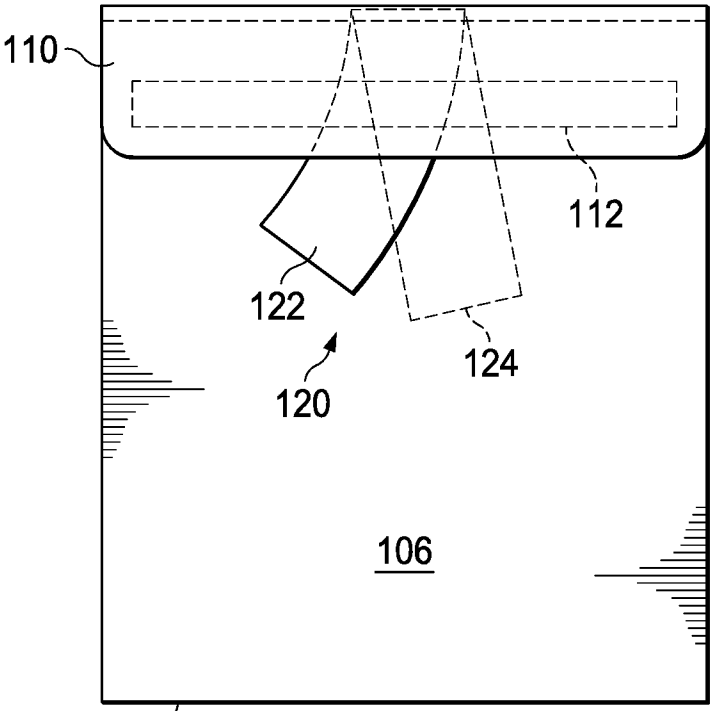
FIG. 1B depicts the example implementation of FIG. 1A in a sealed configuration with a portion of the paper receipt component being visible on the exterior of the tamper-resistant container.

Example implementations are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the disclosed inventive subject matter. Accordingly, the following implementations are set forth without any loss of generality to, and without imposing limitations upon, the claimed subject matter. With regard to certain terminology use herein, it is to be understood that the terms "receipt" and "label" may be used interchangeably to refer to the same structure or item.

Figure 1A:
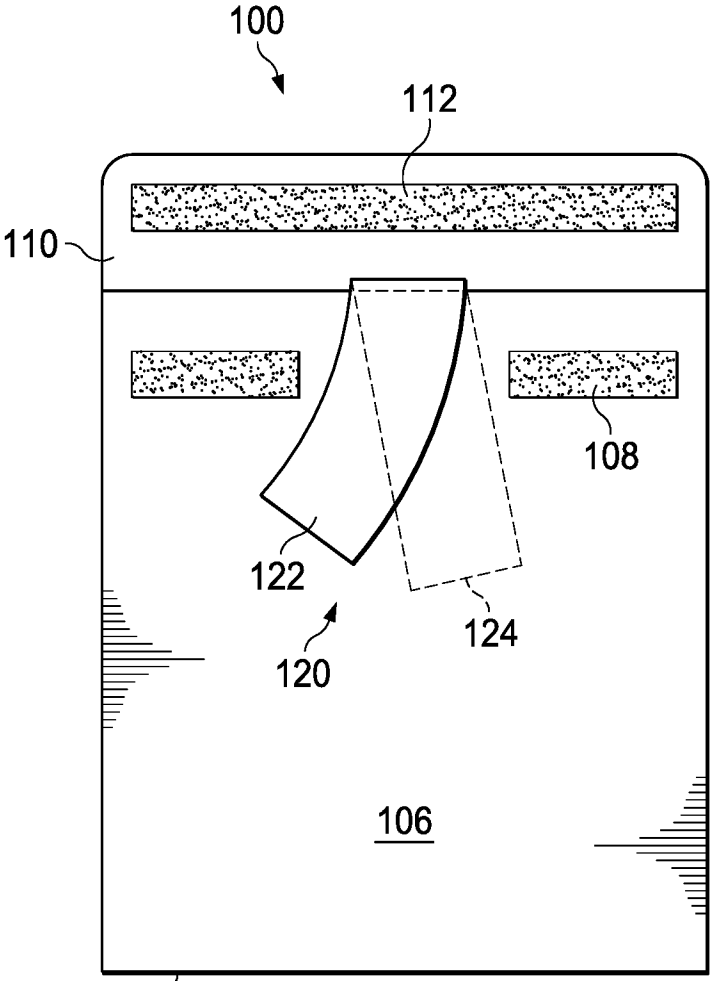
FIG. 1A depicts a first example implementation of the disclosed tamper-resistant containers, wherein the container is an envelope shown in an unsealed configuration.

FIG. 1A depicts a first example implementation of the disclosed tamper-resistant containers, wherein the container is an envelope shown in an unsealed configuration and FIG. 1B depicts the example implementation of FIG. 1A in a sealed configuration with a portion of the paper receipt component being visible on the exterior of the tamper-resistant container. In FIGS. 1A-1B, tamper-resistant container 100 includes an envelope, sack, or bag component 102 and a receipt component 120. Envelope, sack, or bag component 102 includes closed lower portion 104, middle portion 106, which accommodates various items for storage, and closeable upper portion 110. Adhesive 108 may be deposited on the upper area of middle portion 106 and adhesive 112 may be deposited on closeable upper portion 110. The adhesive allows container 100 to be sealed in a closed configuration simply by folding upper portion 110 onto middle portion 106 and applying pressure. In this implementation, receipt component 120 does not include adhesive, but rather is folded at a predetermined angle and inserted into container 100 prior to the closure and sealing thereof. Exterior portion 122, which includes identifying indicia (e.g., order contents, name of person ordering, delivery address, etc.) remains on the outside of container 100 while interior portion 124 remains within middle portion 106 after closure and sealing. In this manner, receipt component 120 cannot be removed or replaced without damaging the receipt itself or re-opening the sealed container, either of which would provide evidence of tampering to the customer. Various adhesives may be used with this example implementation including latex or rubber based adhesives or any other glue or adhesive material, including self-sealing materials, suitable for use with the disclosed tamper resistant containers.

Figure 2B:
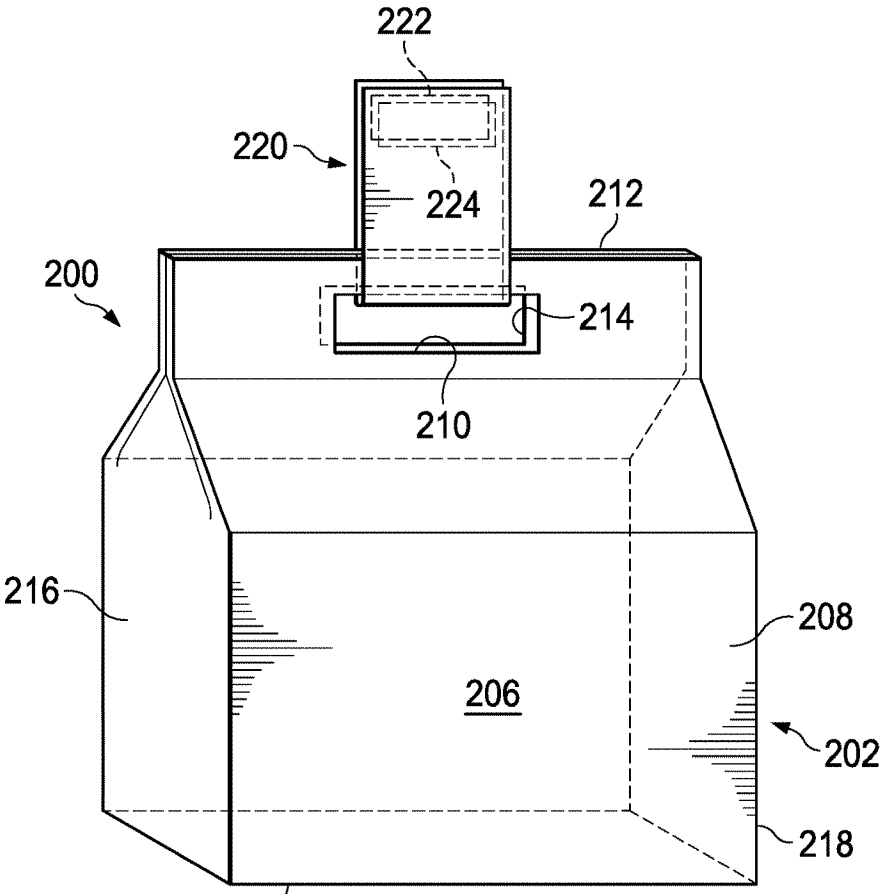
FIG. 2B depicts the example implementation of FIG. 2A shown in a closed or sealed configuration, wherein the paper receipt component has been used as a closure device.
Figure 2A:
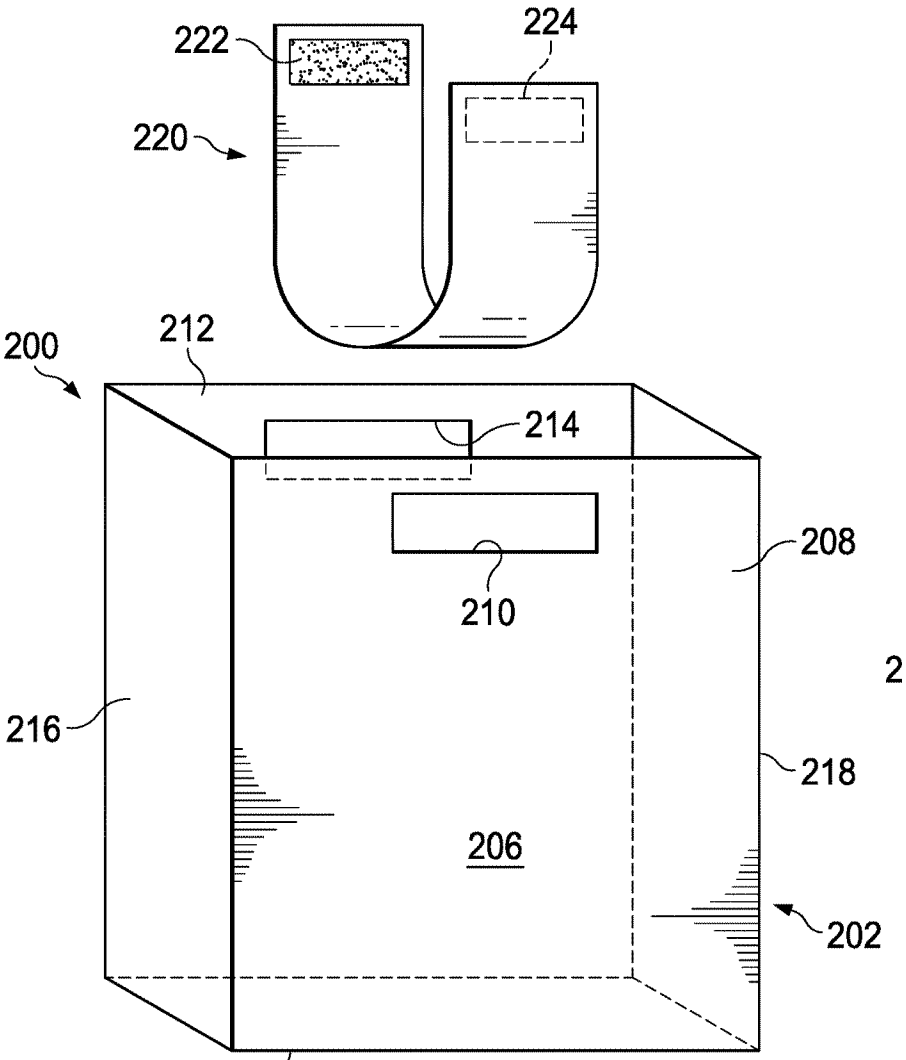
FIG. 2A depicts a second example implementation of the disclosed tamper-resistant containers, wherein the container is a paper bag shown in an open configuration.

FIG. 2A depicts a second example implementation of the disclosed tamper-resistant containers, wherein the container is a paper (or plastic) bag shown in an open configuration; and FIG. 2B depicts the example implementation of FIG. 2A shown in a closed or sealed configuration, wherein the paper receipt component has been used as a closure device. In FIGS. 2A-2B, tamper-resistant container 200 includes bag component 202 and receipt component 220. Bag component 202 includes closed bottom portion 204, middle portion 206, which accommodates various items for storage, front panel 208 in which first slot 210 is formed, rear panel 212, in which second slot 214 is formed, first side panel 216, and second side panel 218. Receipt component 220 includes first adhesive end 222 and second adhesive end 224, which are joined together when receipt component 220 is looped through first slot 210 and second slot 214 to form a closure device. When closed in this manner, container 200 cannot be re-opened without removing the receipt component, and receipt component 220 cannot be removed or replaced without damaging the receipt itself, which would provide evidence of tampering to the customer. Various adhesives may be used with this example implementation including latex or rubber based adhesives or any other glue or adhesive material, including self-sealing materials, suitable for use with the disclosed tamper resistant containers. In some implementations, the topmost portion of the container is folded over once or twice prior to looping the receipt component through the slots to provide a more secure closure and to more effectively retain the contents of the container.

Figure 3A:
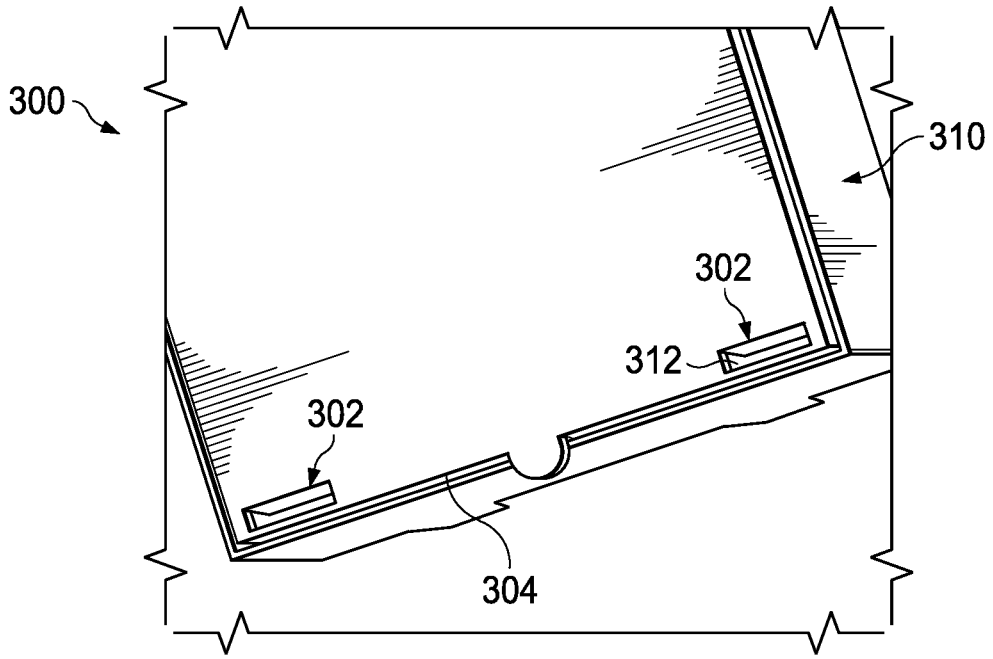
FIG. 3A depicts an example implementation of a storage and transport system for food, wherein two slots have been formed in the front edge of the upper and lower portions of the container to form channels configured to receive self-sealing receipts.
Figure 3B:
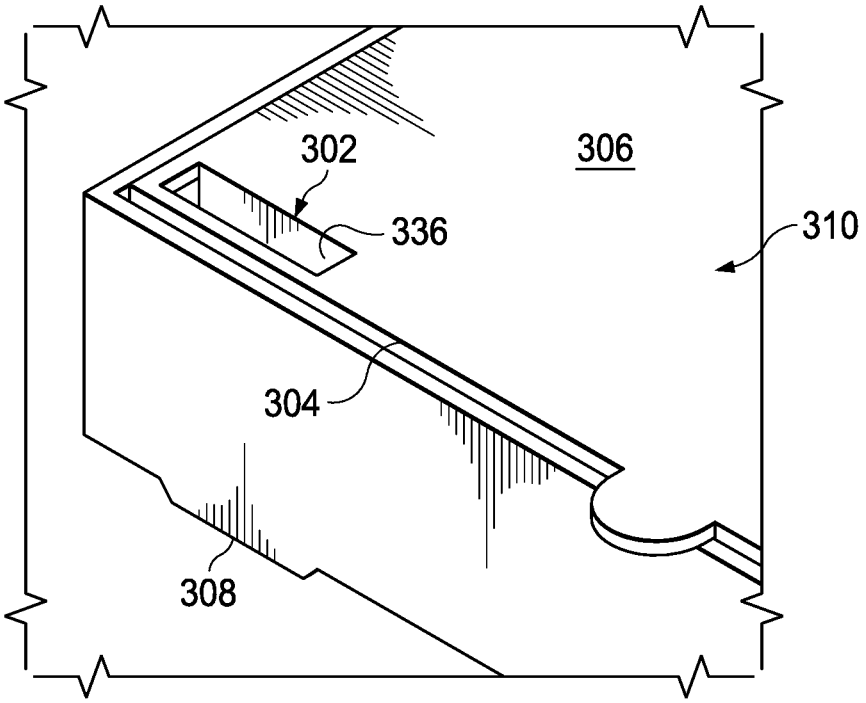
FIG. 3B depicts one of the slots shown in FIG. 3A, wherein the section of the upper portion that collapses in toward the interior of the container is more clearly shown.
Figure 3D:
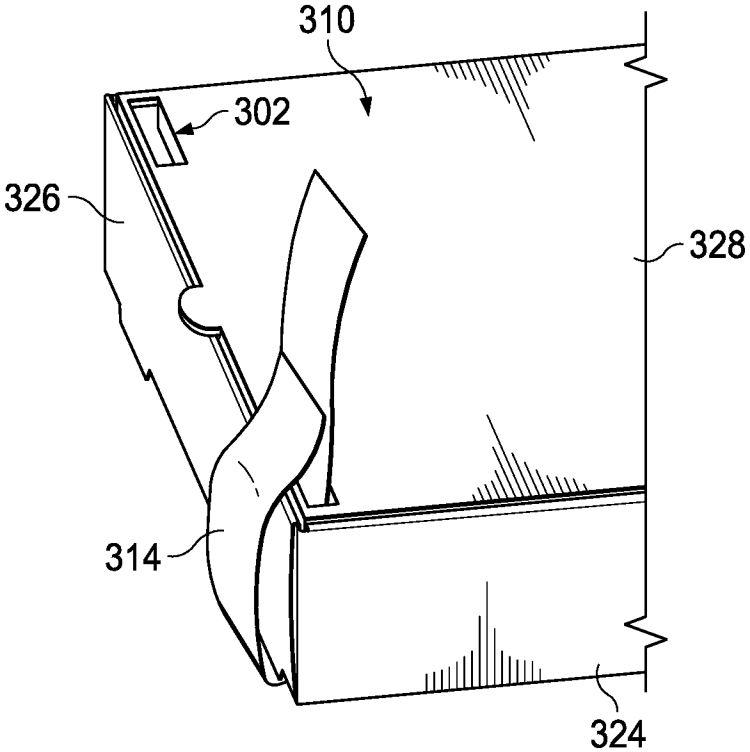
FIG. 3D depicts the self-sealing receipt of FIG. 3C shown in a locked position for sealing the container in a tamper-resistant manner.
Figure 3C:
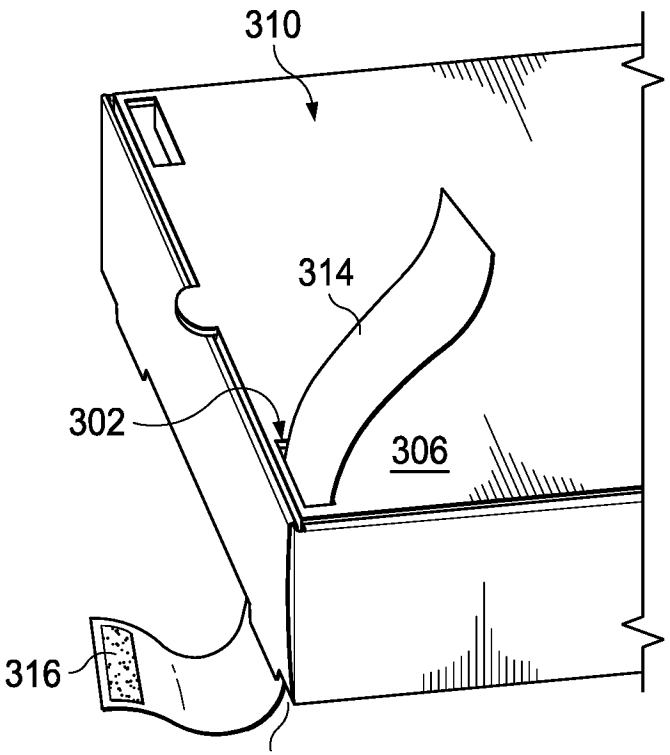
FIG. 3C depicts a self-sealing receipt being inserted first through one of the slots formed in the front edge of the lower portion of the container and then through the corresponding slot formed in the front edge of the upper portion of the container.

FIG. 3A is an illustration of an example implementation of a storage and transport system 300 for food, wherein two slots 302 have been formed in the front edge 304 of the upper and lower portions 306, 308 of a container 310 to form channels 312 configured to receive self-sealing or self-adhering receipts 314. The terms "self-sealing" and "self-adhering" refer to a receipt 314 that includes an adhesive 316 deposited on one side thereof that allows the receipt 314 to stick to itself in a permanent or semi-permanent manner. FIG. 3B is an illustration of one of the slots 302 shown in FIG. 3A, wherein the section of the upper portion 306 that collapses in toward the interior of the container 310 is more clearly shown. FIG. 3C is an illustration of a self-sealing receipt 314 being inserted first through one of the slots 302 formed in the front edge 304 of the lower portion 308 of the container 310 and then through the corresponding slot 302 formed in the front edge 304 of the upper portion 306 of the container 310. FIG. 3D is an illustration of the self-sealing receipt 314 of FIG. 3C shown in a locked position for sealing the container 310 in a tamper-resistant manner.

The container 310 shown in the Figures is of the type typically used to store and transport pizzas or similar food items. Such containers 310 are usually square cardboard boxes that include a bottom portion 324, a raised wall 326 surrounding the bottom portion 324, and a hinged lid 328 attached to a section of the raised wall 326. The first and second channels 312 shown in the Figures may be formed by die cutting the container 310 to include slots 302 in the lid 328 and corresponding slots 332 in the bottom portion 324 or by perforating the lid 328 and bottom portion 324 to include corresponding regions that collapse inward toward the interior of the container 310 when pressure is applied to the perforated areas. As shown in FIG. 3B, the pieces of cardboard 336 that collapse inward create a barrier that prevent the self-sealing receipt 314 or external debris from contacting the pizza or other food contained in the box 310. By sealing the box 310 in the manner disclosed, any attempt to remove the receipt 314 or receipts from the box 310 will result in visible damage to the receipt 314, which provides a clear indication of tampering.

Figure 4A:
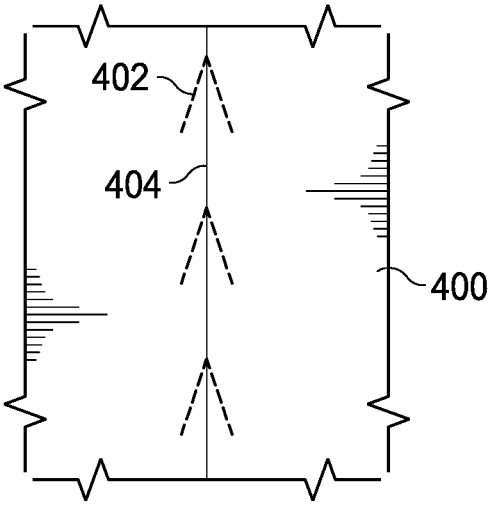
FIG. 4A depicts an example implementation of the self-sealing receipt of FIG. 3D, wherein a series of V-shaped cuts have been formed completely though the material of the receipt to create regions of weakness in the receipt that easily tear when the receipt is separated from the itself.
Figure 4B:
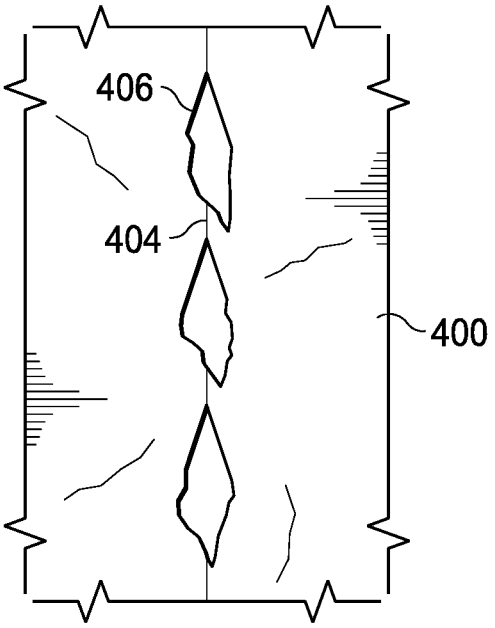
FIG. 4B depicts the self-sealing receipt of FIG. 4A, wherein the receipt has been separated from itself and wherein the regions of weakness formed in the receipt have torn completely through the receipt, thereby providing visual evidence of receipt tampering.
Figure 4C:
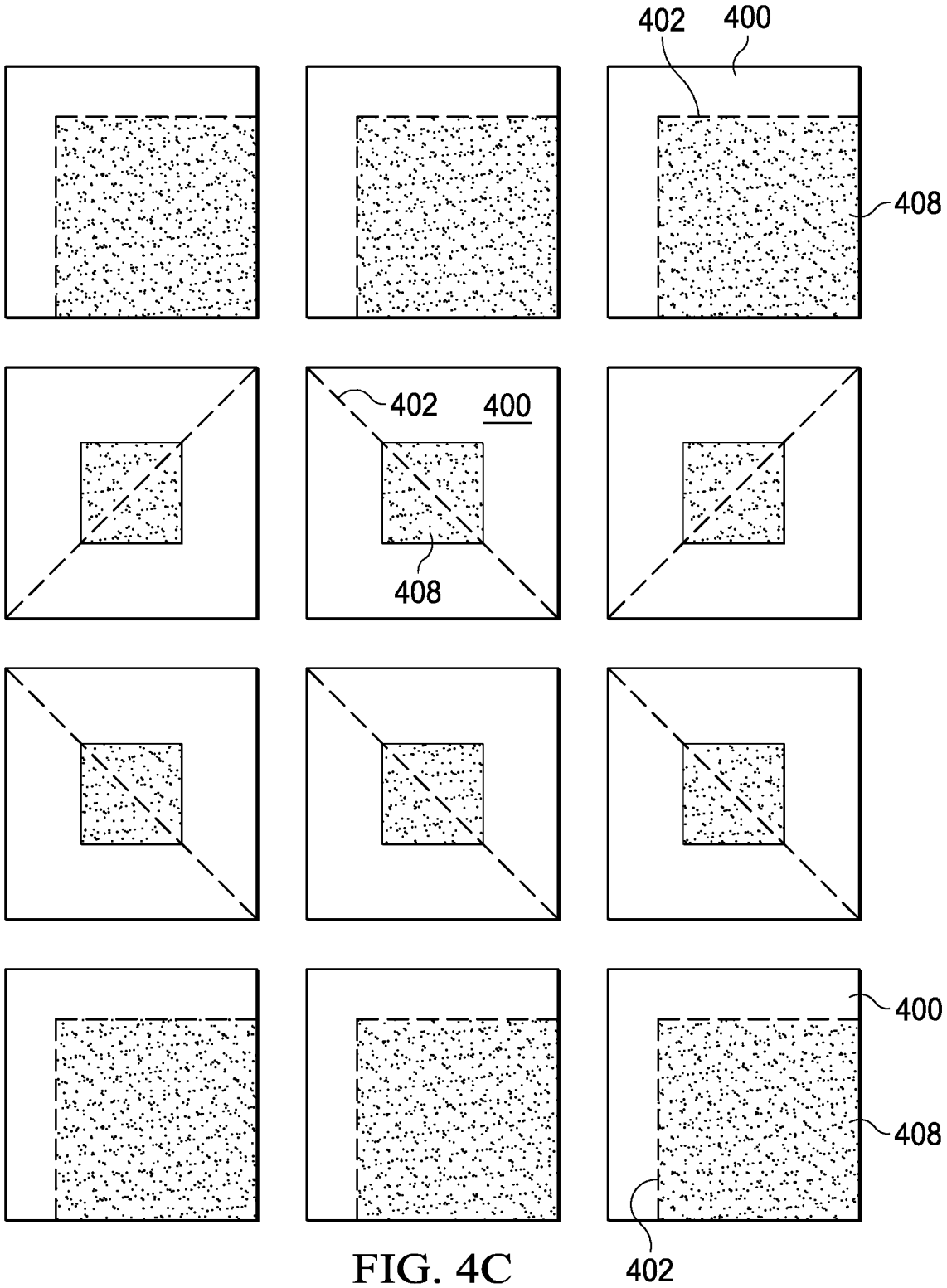
FIG. 4C depicts a series of example patterns for the creation of the regions of weakness in the disclosed self-sealing receipts (slit patterns or cuts), as well as possible placement of adhesive on the receipt relative to the placement of the slit patterns or cuts.

FIG. 4A is an illustration of an example implementation of the self-sealing or self-adhering receipt 400 of FIG. 3D, wherein a series of V-shaped cuts 402 have been formed completely though the material of the receipt 400 to create regions of weakness 404 in the receipt 400 that easily tear when the receipt 400 is separated from itself. FIG. 4B is an illustration of the self-sealing receipt 400 of FIG. 5A, wherein the receipt 400 has been separated from itself and wherein the regions of weakness 404 formed in the receipt 400 have created visible fiber tears 406, thereby providing visual evidence of receipt tampering. The V-shape of the cuts 402 is only one example of a suitable shape or geometry for the cuts 402, and FIG. 4C depicts a series of alternate example patterns for the creation of the regions of weakness 404 in the disclosed self-sealing receipts 400 (slit patterns or cuts), as well as various possible placements of adhesive 408 on the receipt 400 relative to the placement of the slit patterns or cuts 402. The slits or cuts 402 may be formed in various lengths such as, for example, one tenth of an inch. Another implementation of the self-sealing receipt 400 uses an aggressive self-seal bond, which when the label 400 is separated from itself provides visible evidence of adhesive transfer and which cannot be re-adhered (to itself).

Figure 4D:
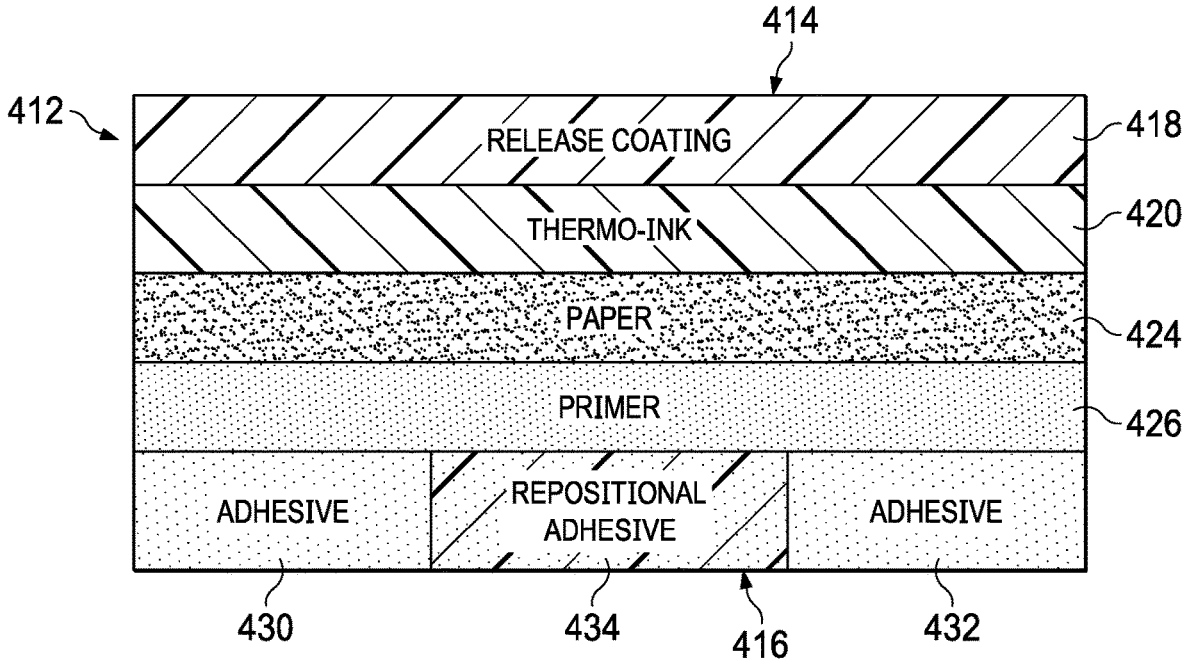
FIG. 4D is a cross-sectional depiction of an example implementation of a self-sealing receipt having a construction that includes a release coating layer; a thermo-ink layer; a paper layer; a primer layer; and an adhesive layer, wherein the adhesive layer may be a permanent pressure-sensitive adhesive, a cohesive, a remoistenable adhesive, or a repositionable adhesive, and wherein the adhesive may be deposited in adjacent strips, an example of which includes first and second cohesives with a repositionable adhesive deposited therebetween.

Now referring to FIG. 4D, an example implementation of the disclosed self-sealing receipt 400 includes a linerless self-sealing system 412 having the following construction, from top 414 (the side of the receipt 400 that receives printing) to bottom 416 (the side of the receipt 400 upon which an adhesive 408 is deposited): (i) a release coating layer 418, wherein the release coating 418 is a water-based coating, an ultraviolet coating, or an electron beam coating; (ii) a thermo-ink layer 420, which may be include a leuco dye, and which may be inkjet-based or laser-based; (iii) an uncoated paper layer 424; (iv) a primer layer 426, which may be optional; and (v) an adhesive layer 408. The adhesive 408 may be permanent pressure-sensitive adhesive (e.g., acrylic-based or rubber-based), cohesive (e.g., natural rubber or synthetic rubber), remoistenable adhesive (e.g., polyvinyl acetate, polyvinyl alcohol, or dextrin), or repositionable adhesive (e.g., acrylic microspheres or cross-linked acrylic). The adhesive 408 may be deposited in adjacent strips, an example of which includes first and second cohesives 430, 432 with a repositionable adhesive 434 deposited therebetween. The adhesive 408 may also be deposited using a cohesive flood coat or in segments. The receipt 400 may be scored or cut 100% through the depth of the material of the label 400 in segments after the deposition of the adhesive 408 using different patterns to create an "easy-tear" system (see FIG. 4C).

As previously stated and as used herein, the singular forms "a," "an," and "the," refer to both the singular as well as plural, unless the context clearly indicates otherwise. The term "comprising" as used herein is synonymous with "including," "containing," or "characterized by," and is inclusive or open-ended and does not exclude additional, unrecited elements or method steps. Although many methods and materials similar or equivalent to those described herein can be used, particular suitable methods and materials are described herein. Unless context indicates otherwise, the recitations of numerical ranges by endpoints include all numbers subsumed within that range. Furthermore, references to "one implementation" are not intended to be interpreted as excluding the existence of additional implementations that also incorporate the recited features. Moreover, unless explicitly stated to the contrary, implementations "comprising" or "having" an element or a plurality of elements having a particular property may include additional elements whether or not they have that property.

Underlined and/or italicized headings and subheadings are used for convenience only, do not limit the disclosed subject matter, and are not referred to in connection with the interpretation of the description of the disclosed subject matter. All structural and functional equivalents to the elements of the various implementations described throughout this disclosure that are known or later come to be known to those of ordinary skill in the art are expressly incorporated herein by reference and intended to be encompassed by the disclosed subject matter. Moreover, nothing disclosed herein is intended to be dedicated to the public regardless of whether such disclosure is explicitly recited in the above description.

There may be many alternate ways to implement the disclosed inventive subject matter. Various functions and elements described herein may be partitioned differently from those shown without departing from the scope of the disclosed inventive subject matter. Generic principles defined herein may be applied to other implementations. Different numbers of a given module or unit may be employed, a different type or types of a given module or unit may be employed, a given module or unit may be added, or a given module or unit may be omitted.

It should be appreciated that all combinations of the foregoing concepts and additional concepts discussed in greater detail herein (provided such concepts are not mutually inconsistent) are contemplated as being part of the disclosed inventive subject matter. All combinations of claimed subject matter appearing at the end of this disclosure are contemplated as being part of the inventive subject matter disclosed herein. While the disclosed inventive subject matter has been illustrated by the description of example implementations, and while the example implementations have been described in certain detail, there is no intention to restrict or in any way limit the scope of the appended claims to such detail. Additional advantages and modifications will readily appear to those skilled in the art. Therefore, the disclosed inventive subject matter in its broader aspects is not limited to any of the specific details, representative devices and methods, and/or illustrative examples shown and described. Accordingly, departures may be made from such details without departing from the spirit or scope of the general inventive concept.

What is claimed:

1. A system for storing and transporting food, comprising:

(a) a container, wherein the container has:

(i) a bottom panel having at least one slot formed therein; and (ii) a lid parallel to the bottom panel having at least one slot formed therein that corresponds to the slot formed in the bottom panel, and wherein when the container is in a closed position, the corresponding slots form at least one channel passing completely through the container; and (b) a self-sealing receipt or label configured to receive printed information regarding the contents of the container, (c) wherein the self-sealing receipt or label passes through the at least one channel and is sealed to itself to securely close the container, and (d) wherein the self-sealing receipt or label is configured to provide visual evidence of tampering when the self-sealing receipt or label is separated from itself.

2. The system of claim 1, wherein the container is a pizza box.

3. The system of claim 1, wherein the slots are formed by perforating corresponding sections of the lid of the container and the bottom panel of the container to create collapsible regions.

4. The system of claim 1, wherein the self-sealing receipt or label includes a plurality of cuts formed completely through the material of the receipt or label, wherein the plurality of cuts form regions of weakness in the receipt or label for providing visual evidence of receipt or label tampering when the self-sealing receipt or label is separated from itself.

5. The system of claim 1, wherein the self-sealing receipt or label includes an upper surface for receiving printing thereon and a lower surface upon which an adhesive has been deposited.

6. The system of claim 5, wherein the adhesive is permanent pressure-sensitive adhesive, cohesive, remoistenable adhesive, repositionable adhesive, or combinations thereof.

7. The system of claim 5, wherein the adhesive has been deposited in adjacent strips, and wherein the strips contain different types of adhesives.

8. The system of claim 1, wherein the visual evidence of tampering includes visible fiber tears in the receipt or label.

9. The system of claim 1, wherein the visual evidence of tampering includes visible adhesive transfer from one portion of the receipt or label to another portion of the receipt or label.

10. A system for storing and transporting food, comprising:

(a) a container, wherein the container has:

(i) a bottom panel having at least one slot formed therein;

(ii) a raised wall surrounding the bottom panel; and (iii) a hinged lid attached to a section of the raised wall, wherein the hinged lid has at least one slot formed therein that corresponds to the slot formed in the bottom panel, and wherein when the container is in a closed position, the corresponding slots form at least one channel passing completely through the container, and wherein the container is configured for use as a pizza box; and (b) a linerless self-sealing receipt or label configured to receive printed information regarding the contents of the container, (c) wherein the self-sealing receipt or label passes through the at least one channel and is sealed to itself to securely close the container, and (d) wherein the self-sealing receipt or label is configured to provide visual evidence of tampering when the self-sealing receipt or label is separated from itself.

11. The system of claim 10, wherein the slots are formed by perforating corresponding sections of the hinged lid and the bottom panel of the container to create collapsible regions.

12. The system of claim 10, wherein the self-sealing receipt or label includes a plurality of cuts formed completely through the material of the receipt or label, wherein the plurality of cuts form regions of weakness in the receipt or label for providing visual evidence of receipt or label tampering when the self-sealing receipt or label is separated from itself.

13. The system of claim 10, wherein the self-sealing receipt or label includes an upper surface for receiving printing thereon and a lower surface upon which an adhesive has been deposited.

14. The system of claim 13, wherein the adhesive is permanent pressure-sensitive adhesive, cohesive, remoistenable adhesive, repositionable adhesive, or combinations thereof.

15. The system of claim 13, wherein the adhesive has been deposited in adjacent strips, and wherein the strips contain different types of adhesives.

16. The system of claim 10, wherein the visual evidence of tampering includes visible fiber tears in the receipt or label.

17. The system of claim 10, wherein the visual evidence of tampering includes visible adhesive transfer from one portion of the receipt or label to another portion of the receipt or label.

18. A system for storing and transporting food, comprising:

(a) a container, wherein the container has;

(i) a bottom portion panel having at least one slot formed therein;

(ii) a raised wall surrounding the bottom panel; and (iii) a hinged lid attached to a section of the raised wall, wherein the hinged lid has at least one slot formed therein that corresponds to the slot formed in the bottom panel, and wherein when the container is in a closed position, the bottom panel and the lid are substantially parallel and the corresponding slots form at least one channel passing completely through the container, and wherein the slots are formed by perforating corresponding sections of the hinged lid and the bottom panel of the container to create collapsible regions; and (b) a linerless self-sealing receipt or label configured to receive printed information regarding the contents of the container, (c) wherein the self-sealing receipt or label includes an upper surface for receiving printing thereon and a lower surface upon which an adhesive has been deposited, (d) wherein the self-sealing receipt or label passes through the at least one channel and is sealed to itself to securely close the container, and (e) wherein the self-sealing receipt or label is configured to provide visual evidence of tampering when the self-sealing receipt or label is separated from itself.

19. The system of claim 18, wherein the self-sealing receipt or label includes a plurality of cuts formed completely through the material of the receipt or label, wherein the plurality of cuts form regions of weakness in the receipt or label for providing visual evidence of receipt or label tampering when the self-sealing receipt or label is separated from itself.

20. The system of claim 18, wherein the self-sealing receipt or label includes an upper surface for receiving printing thereon and a lower surface upon which an adhesive has been deposited, and wherein the adhesive is permanent pressure-sensitive adhesive, cohesive, remoistenable adhesive, repositionable adhesive, or combinations thereof.

* * * * *